US007548711B2

(12) United States Patent
Ziegelmuller et al.

(10) Patent No.: US 7,548,711 B2
(45) Date of Patent: Jun. 16, 2009

(54) WEB CLEANING APPARATUS FOR ELECTROGRAPHIC PRINTER

(75) Inventors: Francisco L. Ziegelmuller, Penfield, NY (US); Thomas C. Bidwell, Bergen, NY (US); Dennis J. Grabb, Sodus, NY (US); Daniel R. Palmer, Rochester, NY (US); Matthias H. Regelsberger, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 442 days.

(21) Appl. No.: 11/394,728

(22) Filed: Mar. 31, 2006

(65) Prior Publication Data

US 2007/0231004 A1 Oct. 4, 2007

(51) Int. Cl.
*G03G 15/20* (2006.01)

(52) U.S. Cl. ..... 399/123; 399/164; 399/351

(58) Field of Classification Search ..... 399/123, 399/164, 350, 351
See application file for complete search history.

(56) References Cited

U.S. PATENT DOCUMENTS 4,519,693 A * 5/1985 Skeels
4,866,483 A 9/1989 Davis et al.
5,426,485 A 6/1995 Fujita et al.
5,617,195 A * 4/1997 Torimaru et al. ..... 399/123
6,453,134 B1 9/2002 Ziegelmuller et al.
6,901,227 B2 5/2005 Ziegelmuller et al.
2002/0076237 A1* 6/2002 Ziegelmuller et al. ..... 399/123
2004/0076446 A1* 4/2004 Ziegelmuller et al.

FOREIGN PATENT DOCUMENTS

JP 01128083 A * 5/1989

* cited by examiner

*Primary Examiner*—David M Gray
*Assistant Examiner*—Laura K Roth
(74) *Attorney, Agent, or Firm*—Donna P. Suchy

(57) ABSTRACT

A cleaning station for removing particulate material from a moving web in an electrographic printer/copier includes a customer-replaceable web-cleaner device with a support bracket/backup shoe assembly. A quick disconnect feature enables the cleaner cover to be de-coupled from the cleaner body to allow the debris to be easily removed with replacing the web-cleaner. The cleaner has a cleaner sump that is spring loaded to force contact of four strategically placed stops in the sump with a stationary back up shoe assembly allowing for higher precision of blade engagement with a transport web or a photoconductor. The web-cleaner has two wiper blades that are locked into the cleaner sump by springs, to facilitate dumping of material removed from the web without removing the cleaning blades. The sump has baffles molded into the sump to eliminate extra parts and has several features that enable easy attachment of the cleaning blades, a permanently attached foam seal around the perimeter of the cover and sump interface. The wiper cleaning blades and the cover assembly are easily replaceable by the operator.

24 Claims, 10 Drawing Sheets

WEB CLEANING APPARATUS FOR ELECTROGRAPHIC PRINTER

FIELD OF THE INVENTION

This invention relates in general to improvements in a cleaning apparatus of the type used, for example, in electrographic document printers or copiers to remove residual toner, carrier, dust, lint, paper fibers, and the like, from a moving surface, typically in the form of an endless web. More particularly, it relates to a removable web cleaning apparatus that can be precisely and repeatedly positioned adjacent to a moving web that is to be continuously cleaned by the apparatus.

BACKGROUND OF THE INVENTION

Many electrographic printers/copiers use endless webs for recording and/or transferring images, as well as for conveying image-receiving sheets (typically sheets of paper) between image-transfer and other image-processing stations within the instrument. To assure high quality results, it is necessary to maintain the surfaces of such webs free of particulate contaminates (toner, dust, lint, paper fibers, etc) that may ultimately transfer to the image-receiver sheet or otherwise degrade the quality of images produced thereon. Heretofore, a variety of web-cleaning devices have been devised and used to satisfy this need. One such device is generally referred to as a "blade cleaner" and, as its name suggests, it comprises one or more elongated flexible blades having an edge positioned to contact a moving web to either scrape or wipe particles from the web, depending on the angle of contact between the blade and the web surface. Different types of blade cleaners, both scrapers and wipers, are disclosed, for example, in U.S. Pat. No. 5,426,485 in which cleaning blades serve to remove particulate material from an endless elastic belt used to convey copy sheets in an electrostatic copier.

In U.S. Pat. No. 4,866,483, a blade-type cleaning station is disclosed for use in a tabletop electrostatic printer. Here a pair of spaced, parallel cleaning blades set to operate in a wiping mode, serves to remove or scavenge residual toner from an endless photoconductive image-recording belt following transfer of a toner image to a copy sheet. As the image-recording belt moves along its endless path, scavenged toner falls into a sump from which it is continuously removed by a rotatably driven auger. The rotating auger, which is located in the bottom of the sump, serves to transport the scavenged toner to a remote receptacle that can be readily removed from the machine and emptied by the operator. In this disclosure, the cleaning station is rigidly mounted on the printer's base frame. To gain access to the cleaning station for servicing, and the like, the entire print engine, including the image-recording belt, is mounted on a pivoting frame for movement towards and away from the cleaning station. As it moves towards the cleaning station, the print engine's image-recording belt pressingly engages the respective edges of the cleaning blades and is cleaned by the blades as the belt advances along its endless path. Upon being moved away from the cleaning station, sufficient space is eventually provided to enable the machine operator or service personnel to service the cleaning station, e.g., to vacuum scavenged toner from that portion of the sump directly beneath the cleaning blades, or to replace the cleaning blades themselves.

While the cleaning station disclosed in the above-noted patent affords certain advantages not found in prior devices, it may still be viewed as problematic in certain respects. For example, the rotating auger system used to transport scavenged particles from the blade cleaner to a remote receptacle for removal is a relatively complex and costly component of the machine, one that is subject to eventually fail. Further, since the cleaning station is fixed within the machine frame, pivoting the relatively heavy print engine through a large arc away from the cleaning station can only be accomplished by service access. This, of course, necessitates a relatively formidable and complex mounting mechanism, one that is capable of handling and counter-balancing the relatively heavy weight of the print engine. Ideally, the print engine should remain stationary, and the cleaning station, like most other image-processing stations, should be movable relative to it.

Further, once the print engine has been pivoted to its service position to gain access to the scavenged particle sump for vacuuming, blade replacement, etc., the entire sump is exposed to ambient air, and any air currents in the vicinity of the open sump, as occurs during movement of the print engine, can have the effect of blowing toner, dust, etc. throughout the instrument. Ideally, the scavenged particle sump should be easily removed from the vicinity of the machine frame while scavenged particles are confined therein. Once removed, the sump can then be discarded and replaced with a new sump, or it may be cleaned at a location safely spaced from the machine and then replaced.

In the embodiment disclosed, an endless web to be cleaned is part of a conveyor system used to transport image-receiver sheets past one or more image-transfer stations in an electrophotographic printer. The web-cleaning apparatus comprises a pair of cleaning blades positioned to operate in a wiping mode to scavenge particles from the web surface, and a sump housing that serves both to support the cleaning blades and to collect and retain particles wiped from the web by the blades. Preferably, the blades are designed to cooperate with a hard backup "shoe" located on the opposite side of the web surface from that contacted by the blades to produce a uniform wiping pressure across the web width while minimizing any tendency for the web to stretch. It is also preferred that the cleaning apparatus be fabricated so as to be easily removable for cleaning after the sump housing has become filled with particles. Thereafter, the blades can be readily replaced, as needed, with new blades. This replaceability of the blades necessitates a reliable mechanism by which each new blade can be precisely positioned in contact with the web surface exerting a predetermined and uniform pressure on the web across its entire width.

SUMMARY OF THE INVENTION

The new blade cleaner apparatus for cleaning particulate material from a moving web in an electrographic printer/copier, including a sump having a sump body with molded components, defining a cavity with integral molded baffles, releasable wiper blades made so that the blades do not fall out when inverted; and a removable cover assembly to facilitate the removal of debris material from the sump without removing the wiper blades. The molded components include stops, placement devices and other components that can engagedly cooperate with springs and other biasing devices. The web-cleaning device is attached to a lower bracket and a backup shoe assembly for selectively positioning the web-cleaning device in a web-cleaning position so that the web-cleaning apparatus pressingly engages said surface.

BRIEF DESCRIPTION OF THE DRAWINGS

The invention and its objects and advantages will become apparent upon reading the following detailed description and upon reference to the drawings, in which.

DETAILED DESCRIPTION OF THE INVENTION

While the present invention will be hereinafter described in connection with a preferred embodiment thereof, it will be understood that it is not intended to limit the invention to that embodiment. On the contrary, it is intended to cover all alternatives, modifications and equivalents as may be included within the spirit and scope of the invention, as defined by the appended claims.

Figure 1:
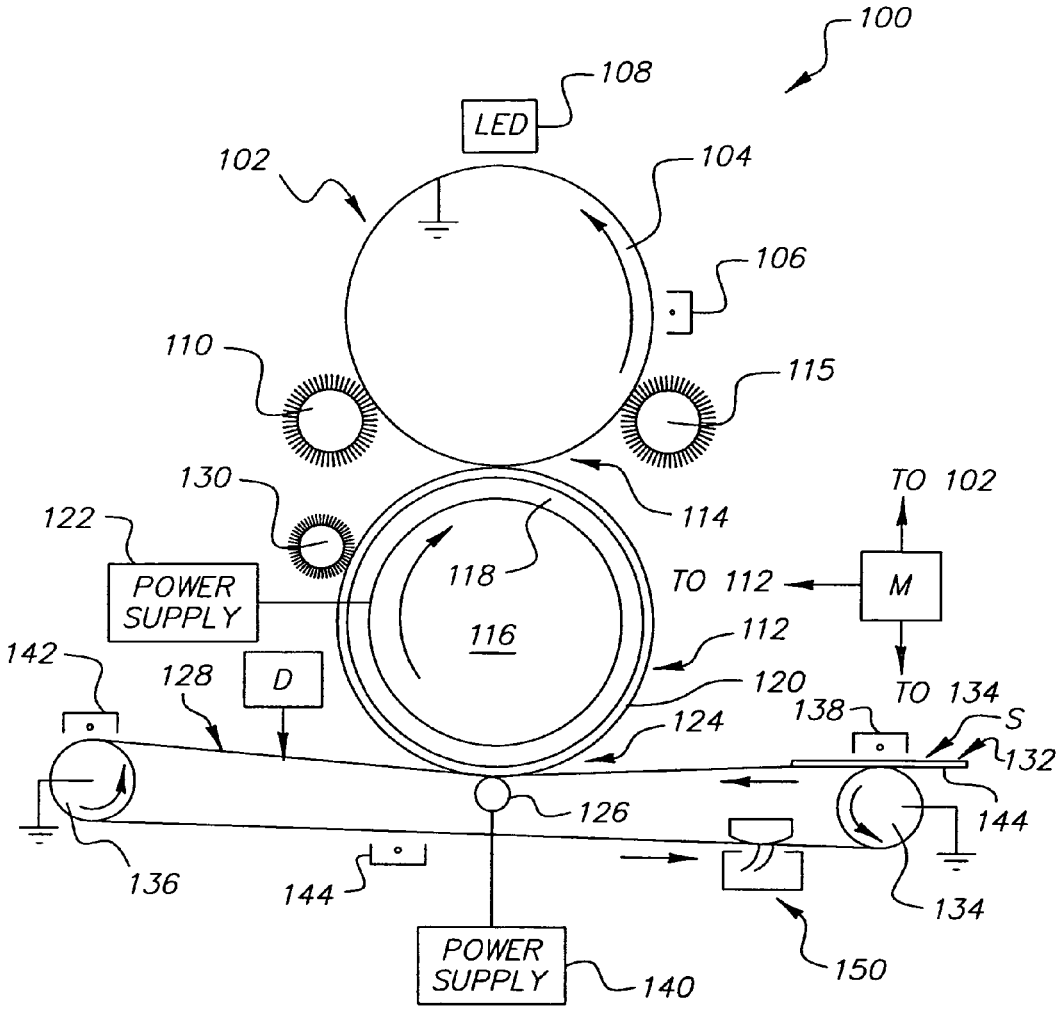
FIG. 1 is a schematic illustration of an electrographic document printer.

Referring now to FIG. 1, a conventional electrophotographic document printer 100 in which the invention has utility is shown to comprise a primary image-forming member 102, for example, a rotatably driven conductive drum having an outer surface of a photoconductive material. One or more transferable toner images are formed on the photoconductive surface of drum 104 by first uniformly charging the surface with electrostatic charge provided by a corona charger 106 or the like. The uniformly charged surface is then imagewise exposed to radiation provided, for example, by a LED writer 108, thereby selectively discharging the charged surface and leaving behind a latent charge image. Finally, the latent charge image is rendered visible (developed) by applying electroscopic toner particles using a magnetic brush applicator 110, or the like. In some printers of this type, a series of toned process control patches (images) are also formed on the surface of the image-recording element, such patches being located in the interframe region between successive image frames.

The above-noted toner images and toned process control patches are then transferred to an intermediate image-transfer member 112 at a transfer nip 114. A cleaning brush 115 prior to recycling the image-recording member through the image-forming process removes any residual toner on the image-recording member 104. The image-transfer member may comprise, for example, an electrically conductive drum 116 having a compliant blanket 118 with a relatively hard overcoat 120. The conductive drum is electrically biased by a power supply 122. The toner images transferred onto intermediate image-transfer member are then re-transferred to an image-receiver sheet S at a transfer nip 124 formed by a relatively small transfer roller 126 and an endless sheet-transport web 128 made of a dielectric material such as a polymer compound. A cleaning brush 130 removes residual toner on member 112.

The image-receiver sheets S are presented to the endless sheet-transport web 128, also referred to as a surface in an electrographic printer, at a feed station 132. Web 128 is trained around a pair of rollers 134 and 136, and a motor M serves to drive roller 134 in the direction indicated by the arrow. Motor M also serves to rotatably drive the image recording and image-transfer drums. The image-receiver sheets (e.g., paper or plastic) attach to web 128 at a corona charging station 138, which operates to charge the top surface of the sheet so that it becomes electrostatically attracted to the web. The grounded rollers 134 and 136 serve to charge to the rear side of the web. Toner images are electrostatically attracted, and thereby transferred, to the image-receiver sheets by a suitable electrical bias applied to transfer roller 126 by power supply 140. There are various chargers including a corona charger 138 at the sheet-feed station 132, a detack charger 142 that serves to detack the image-receiver sheets as they wrap around transport roll 136, thereby freeing the sheets for further transport to a toner fusing station, (not shown) as well as a web conditioning charger 144, that serves to discharge the web and neutralize toner images on the web surface for easier cleaning operation. Note, being outside the image frame areas on the image-recording drum, any toned process-control patches transferred to the image-transfer member 112 will re-transfer directly to the transport web in the region between successive image-receiver sheets. These toned patches must be removed from the web before receiving a new image-transfer sheet. Otherwise, the toner from these patches will transfer to the rear side of the image-receiver sheets.

Now in accordance with the present invention, a web-cleaning apparatus 150 is provided for removing not only the random toner particles, dust, paper debris, etc., that may accumulate on the outer surface sheet of the transport web 128 during repeated use of the printing machine described above, but also any relatively heavy deposits of toner that may be transferred to the web as the result of forming the aforementioned process-control patches on the image-recording drum, paper jams, misregistration of the toner image with the image-receiver sheets, etc.

Figure 2:
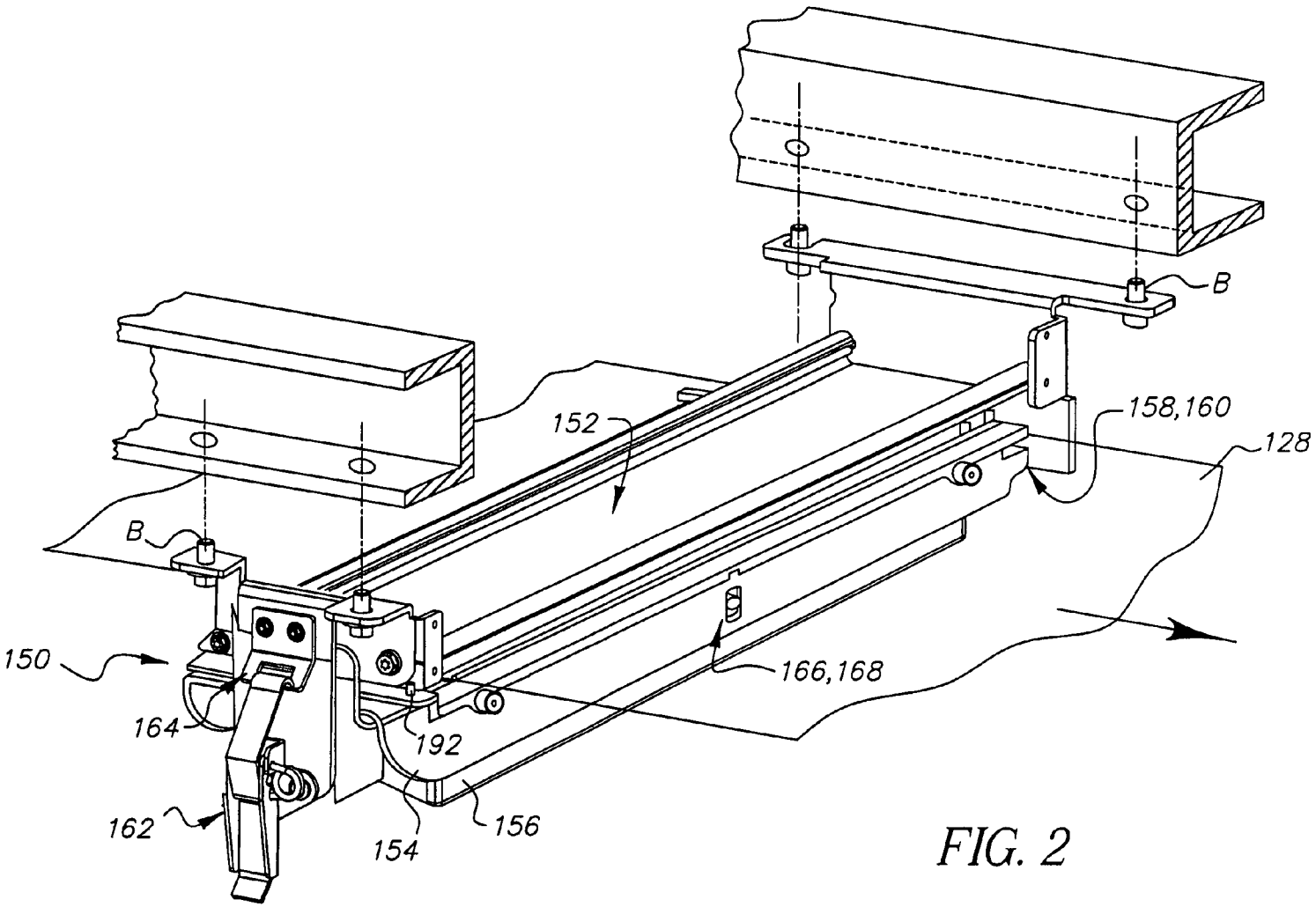
FIG. 2 is a perspective view of a preferred embodiment of the web cleaning apparatus of the invention, such apparatus shown to be operating on the surface of a sheet-transport web of the FIG. 1 printer.
Figure 3A:
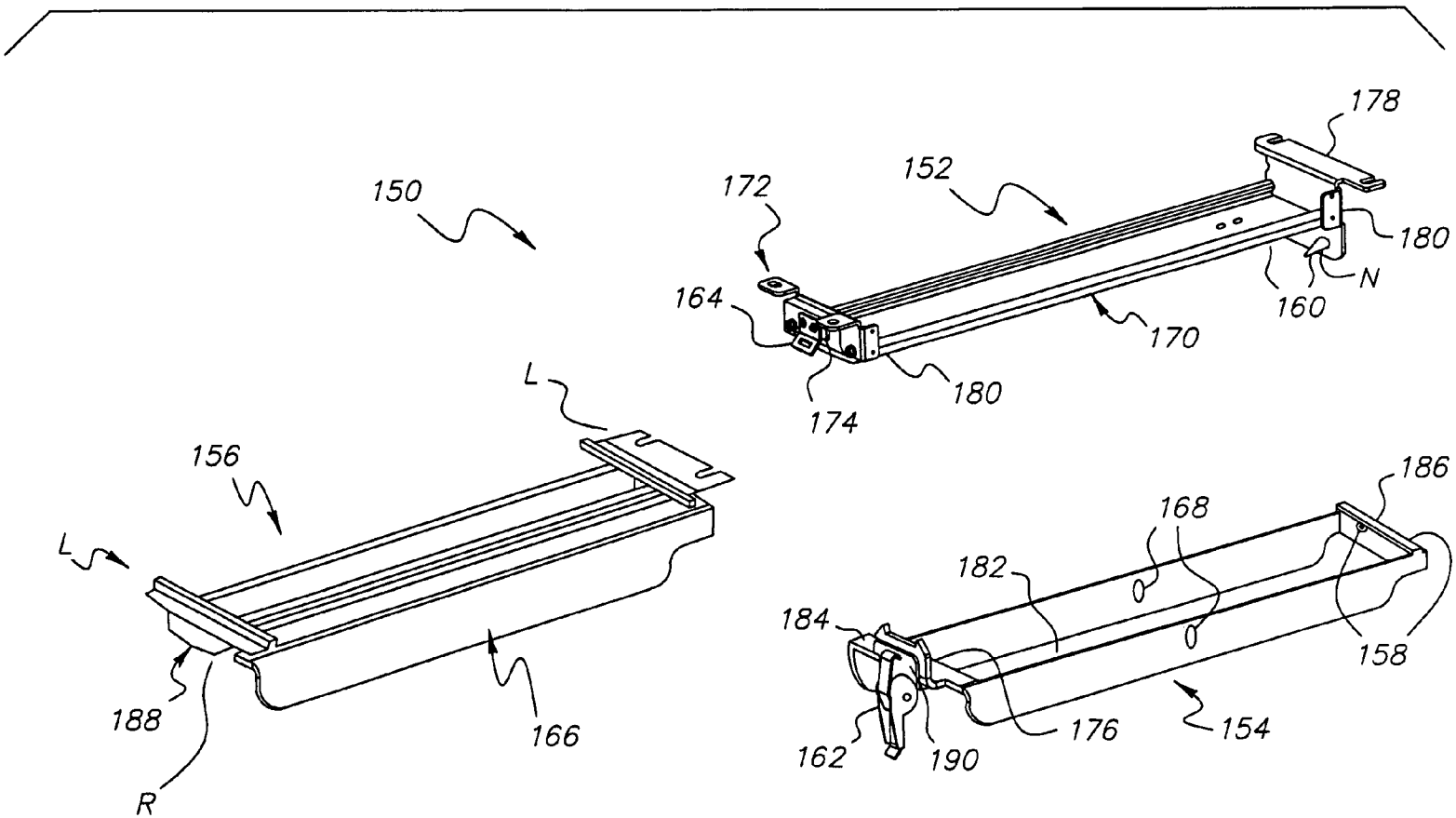
FIG. 3A is an exploded, perspective view of three major components of the web-cleaning apparatus.
Figure 3B:
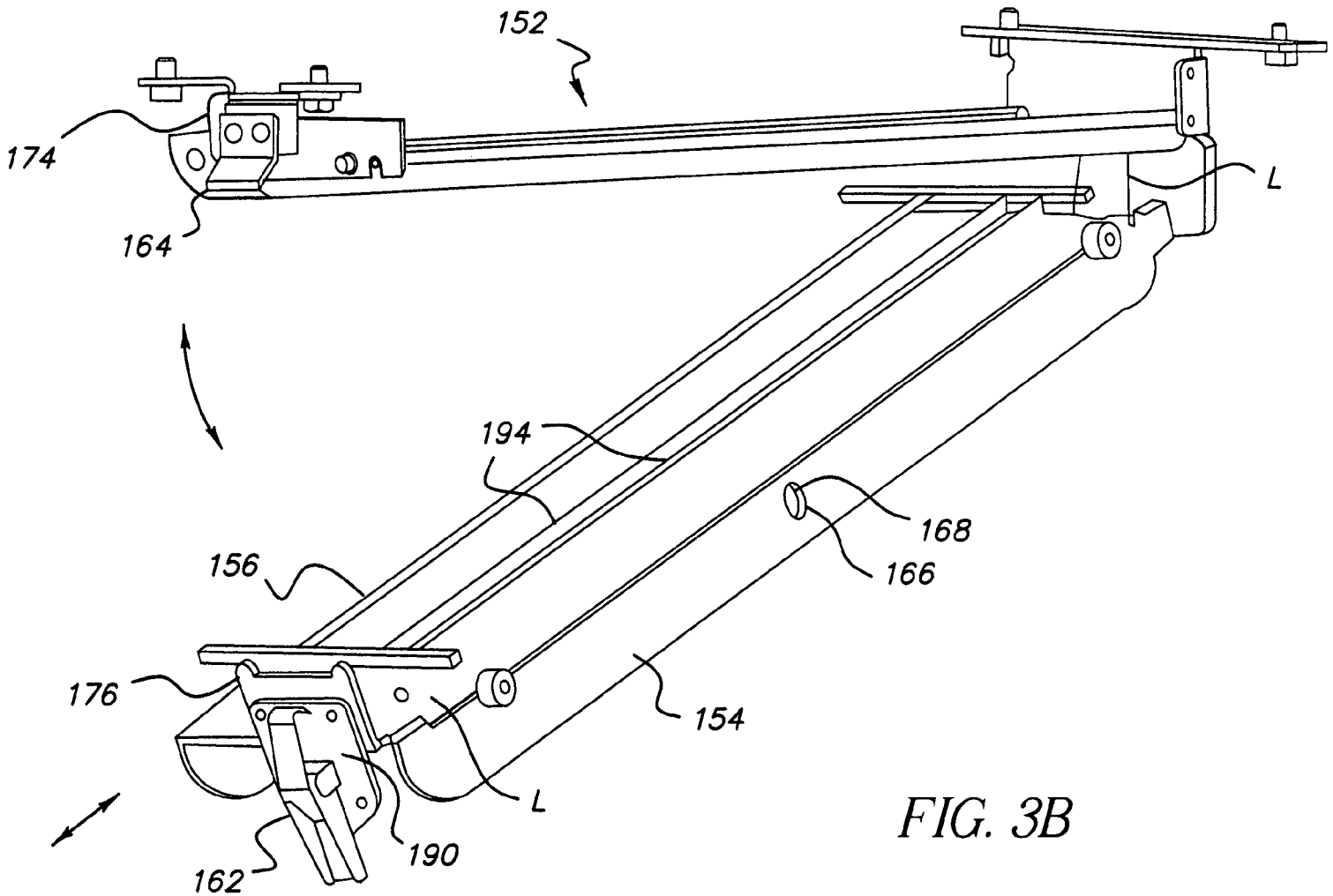
FIG. 3B is a perspective view illustrating the pivotal relationship between the lower bracket and backup shoe assemblies of the apparatus.

Referring to FIGS. 2 and 3, a preferred web-cleaning apparatus 150 is shown as comprising three major components, namely a backup shoe assembly 152, a lower bracket assembly 154 and a web-cleaning device, hereafter referred to as a cartridge 156, in an operating position with respect to a moving sheet-transport web 128. It is clear that this web-cleaning device may be removable as a whole, and replaceable or it may be a device that is difficult to remove and meant to be a permanent installation. The term cartridge is in no way meant to limit the device functionality. The backup shoe assembly 152 is permanently attached to the printer through screws B at front and at rear. The lower bracket assembly 154 is coupled to the backup shoe assembly at the rear by mating hole pattern 158 in the bracket to notched pins 160 in the backup shoe assembly and at front through a latch 162 and a latch keeper 164. The web-cleaning cartridge 156 is attached to the lower bracket assembly via two lower bosses 166 on the sides of the cartridge that lockedly fit into side slot features 168 in the lower bracket assembly and this allows the operator to remove the lower bracket assembly with the web-cleaning cartridge as one unit (FIG. 3B). The web moves in the direction shown by the arrow and further described in the cross-referenced U.S. Pat. No. 6,453,134, issued on Sep. 17, 2002, in the names of Ziegelmuller et al., the contents of which being hereby incorporated by reference herein.

Referring to FIG. 3A, the backup shoe assembly152 has a shoe 170, preferably made of Aluminum or steel, with a large radius of curvature, such as 500 mm, and which has a conductive, wear-resistant coating, such as one including chromium, which engages the web 128 to generate a wrap; a front bracket 172 that spaces the shoe 170 from the machine frame to provide proper wrap with the web and that has a tab feature 174 for mating with a similar tab feature 176 in the lower bracket assembly 154 at front and serves as a mount for the latch keeper 164, and a rear bracket 178 that also serves to set the proper wrap of the shoe with the web 128 and holds two notched pins 160 that have a cone-shaped form to guide the mating of the hole pattern 158 at the rear of the lower bracket assembly 154 into the correct position with respect to the shoe. The notches N in the pins serve to hold the lower bracket assembly with the web-cleaning cartridge in place at the rear whenever the operator needs to drop the web-cleaning cartridge from contact with the web 128, as shown in FIG. 3B. These notches reduce the likelihood of the lower bracket assembly collapsing at the rear whenever the operator lowers the bracket at front. To fix the notches in the pins in parallelism facing the top, there are hole features with slots at the rear bracket and mating features in the pin to prevent the pins from rotating out of alignment when tightening the bolts at the rear. These features are not shown. Both front and rear brackets 172, 178 have side tab features 180 to hold a static dissipative discharge brush facing the inside of the web surface to control triboelectric charge build up (not shown here).

The lower bracket assembly 154 has a rectangular opening 182 for housing the web-cleaning cartridge; sides with slots 168 for housing the lower bosses 166 in the cleaning cartridge and for locking the cartridge in place; front and rear flat surfaces 184, 186 for supporting the web-cleaning cartridge 156 through the end springs 188, one at front and the other at rear of the cartridge, and bearing the end spring load when the cartridge is in its operative condition; a front tab feature 176 that holds the latch bracket 190 and the latch 162.

The web-cleaning cartridge 156 has two end springs 188, one at front and one at rear, that load the cartridge against the shoe until four strategically positioned stops 192 contacts the shoe. Each end spring 188 is positioned preferably proximate a lip L on one of the sides of the sump. This side could be on the shorter sides, on the front or the back areas of the sump. In one preferred embodiment the end spring(s) are positioned between the sump and the flat surfaces 184, 186 of the lower bracket assembly 154 such that end spring 188 biases the sump towards the shoe 170 until one or more stop(s) 192, shown in this embodiment molded onto the sump, abut against the shoe 170 as shown in FIG. 2. The end spring(s) 188 and the stop(s) 192 allow the higher precision blade engagement necessary to optimize blade angle and reduce support on the wiper blade. The stops have been located outside the web so that they do not wear the web.

Figure 4A:
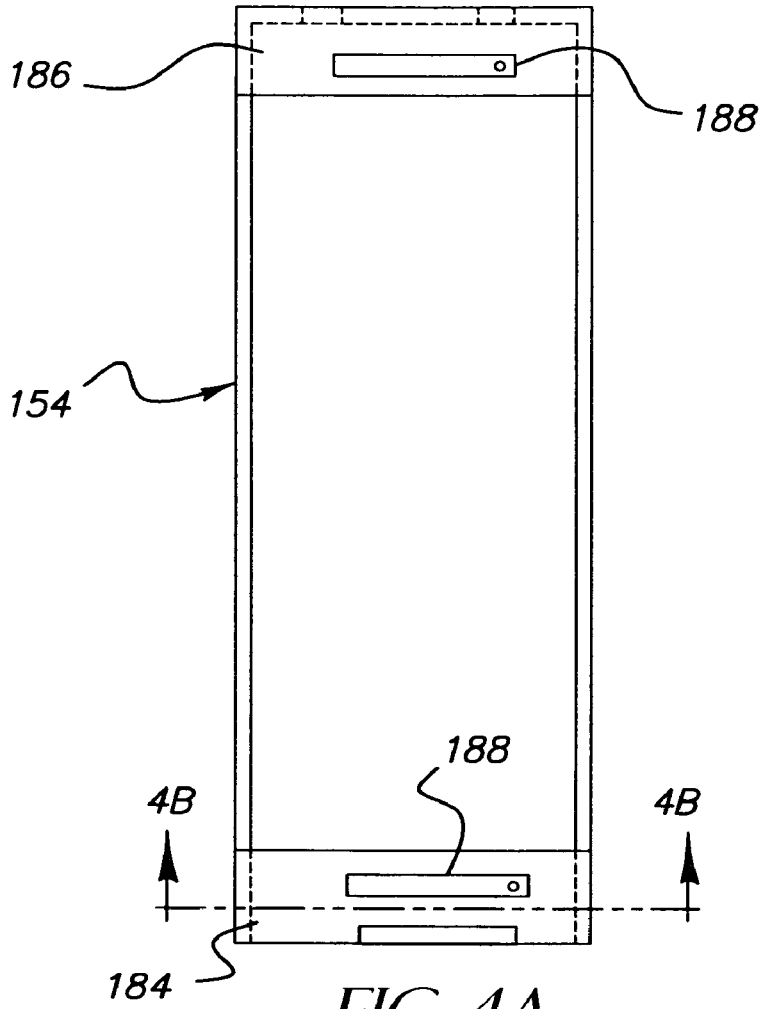
FIGS. 4A-4B are another embodiment of a portion of the web cleaning apparatus.
Figure 4B:
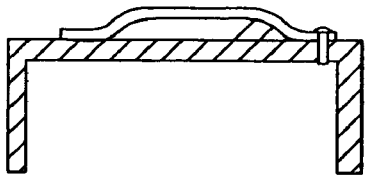

The end spring can be located proximate to the sump in any location that allows a sump to be pushed toward the shoe 170 to control the tolerance between the sump and the shoe. In one preferred embodiment the end springs are located on the flat sides 184, 186 of the lower bracket as shown in FIGS. 4A-4B that allow the spring to cooperate with the cartridge 156 to force contact of Four strategically placed stops in the sump with the stationary back up shoe assembly allowing for higher precision of blade engagement with a transport web or a photoconductor and to prevent damage to the spring or sump.

Another embodiment would locate the end spring proximate a side of the sump wherein the end spring is a molded component of the sump. For example the end spring could be molded as part of the flat surface lip L in the front and back.

Figure 5A:
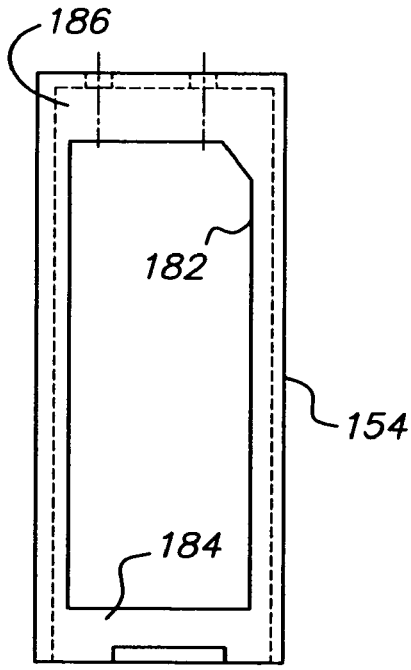
FIGS. 5A-5C are another embodiment of a portion of the web cleaning apparatus.
Figure 5B:
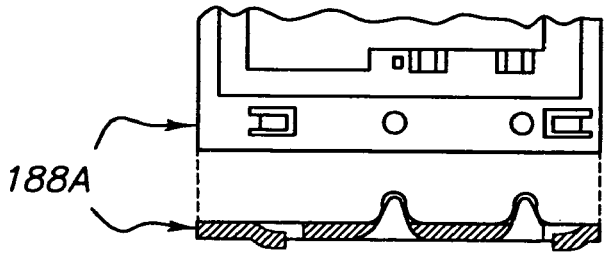
Figure 5C:
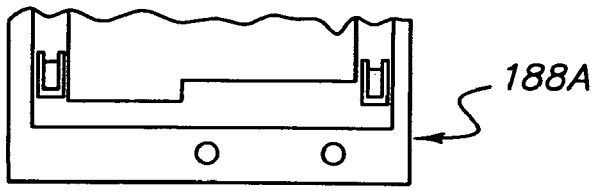

Yet another embodiment shown in FIGS. 5A-5C include an end spring 188A as a molded component of the sump which is added at strategically located positions along the seat 232 of the sump so that these springs would rest against up and downstream lips in another embodiment of the lower bracket. This lower bracket would have these side lips and another notch feature in the opening 182 whose function would be to prevent the web-cleaning cartridge from being installed incorrectly into the opening of the lower bracket. This latter embodiment of the molded springs along the sides of the sump and the lower bracket with sides would allow the operator to easily remove or install the cartridge without risking damage to the springs or the sump and it would eliminate the need for the slots/lower boss features in the cartridge and the lower bracket assembly.

For the $1^{st}$ and $2^{nd}$ embodiments, when the springs are not molded, it is important to have the cartridge 154 seated and locked in the lower bracket assembly 154 and to install these two components as a unit to avoid damaging the springs 188. These springs could otherwise be damaged if the cartridge was forced into the lower bracket as the spring at rear might interfere with the flat surface 186 of the lower bracket. The web-cleaning cartridge 156 is inserted into the opening 182 of the lower bracket assembly 154 and the sides of the bracket are pulled apart to allow the lower bosses 166 to go into the side slots 168 in the bracket.

The lower bracket assembly 154 with the web-cleaning cartridge 156 lockedly in place is installed into the notched pins 160 having cone-shaped form at the rear of the backup shoe assembly by aligning the hole pattern 158 to the pins and the front of the lower bracket assembly is then lifted until there is a mating between the front tab features 174 and 176. The latch 162 is then locked into its keeper 164. The removal process is done in reverse steps. This procedure is illustrated in FIG. 3B. In the process of closing the latch, the springs 188 are compressed forcing the stops 192 onto the shoe and thus providing the high precision of engagement between the wiper blades 194 and the web 128 which is backed up by the shoe 170.

Figure 6:
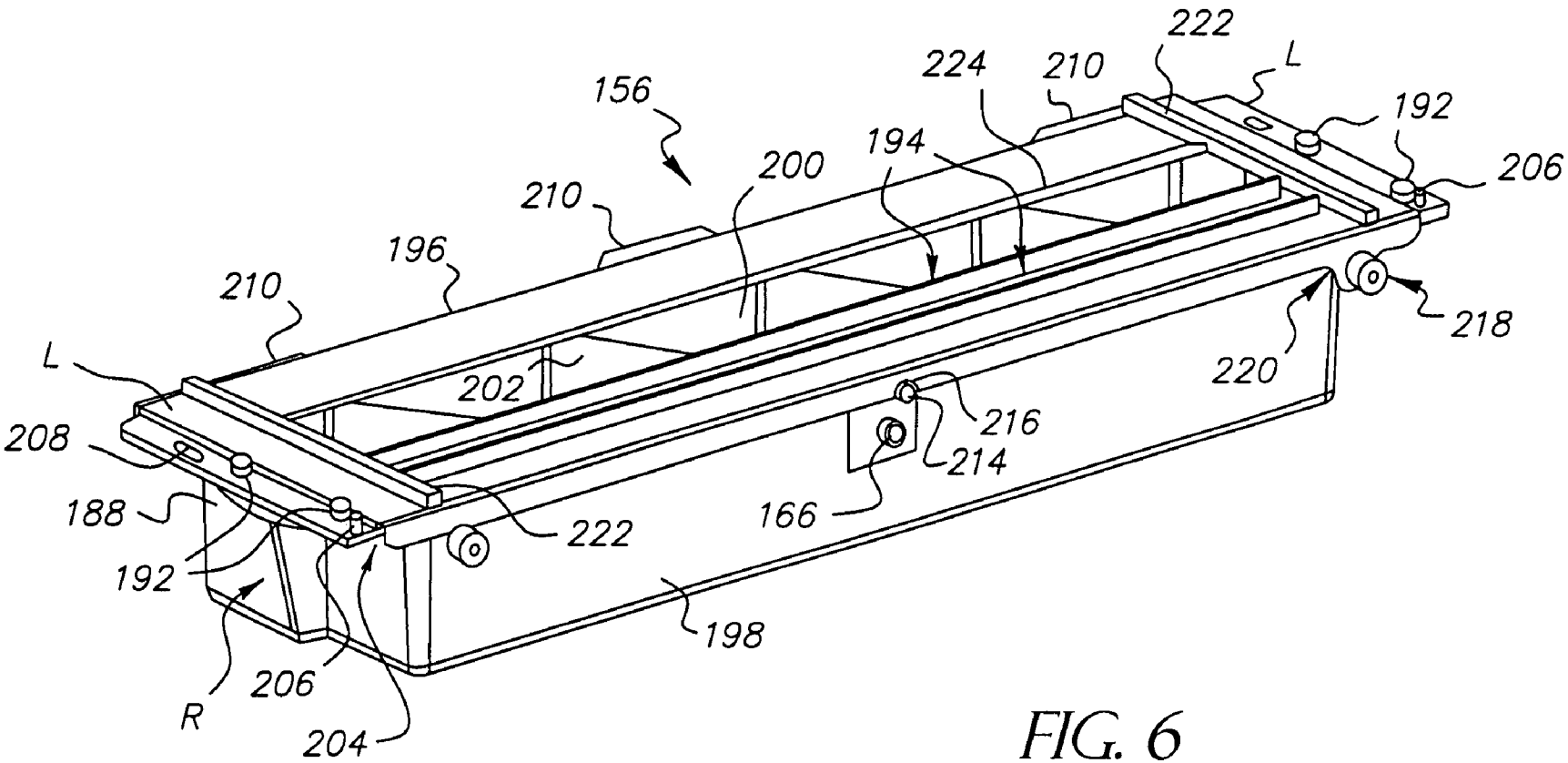
FIG. 6 is a perspective view of the customer-replaceable web-cleaning cartridge.

The web-cleaning cartridge 156 is shown in FIG. 6 with its two customer replaceable components, namely the cover assembly 196 and the cleaning or wiper blades 194 that have a length, in a preferred embodiment, approximately equal to the width of web 128. One skilled in the art understands that this could be achieved with one blade or cumulatively with a plurality of blades or blade segments. The material that the wiper blades can be made from in a preferred embodiment is polyester polyurethane with the following properties: a hardness of between 60 and 85 Shore A, an initial modulus of between 500 and 1500 psi, a Bayshore resiliency above 30%, and a compression set lower than 25% as is described in the aforementioned cross-referenced U.S. Pat. No. 6,453,134, issued on Sep. 17, 2002, in the names of Ziegelmuller et al., the contents of which being hereby incorporated by reference herein.

The web-cleaning cartridge 156 receives and store particles wiped or scavenged from the outer surface of web 128 by the blades and serves not only to prevent scavenged particles from escaping through the top of the cartridge, but also acts to clean the edges of the web 128 as it passes by, and to store particles deflected from the web 128. The cartridge has a sump housing 198 with several molded features such as the lower bosses 166, the stops 192, a cavity 200 for collecting toner from the web, integral molded baffles 202, a cutout 204 for attaching the end springs 188 with a rivet 206, such as a pop rivet, a cutout 208 for allowing the free end of the springs to move freely, slots 210A for receiving tab features 210B in the cover assembly to work as a hinge 210, an upper boss 214 to align the cover assembly notch feature 216 to the sump so fasteners 218 in the cover assembly can be attached to the threaded inserts 220 molded into the sump, not shown here, to lock the cover to the sump, and other molded features that will be better illustrated in FIG. 57. The cover assembly 196 has a rectangular opening O, side seals 222 that seal at the ends of the wiper blades 194, a Mylar blade seal 224 that is attached to a tab feature 226 in the cover assembly, besides other features named above, and other features that are better illustrated in FIG. 7. The blade seal 224 take many forms and materials as long as it is capable of deflecting a sufficient amount to not scavenge a toner from the web during operation.

Figure 7:
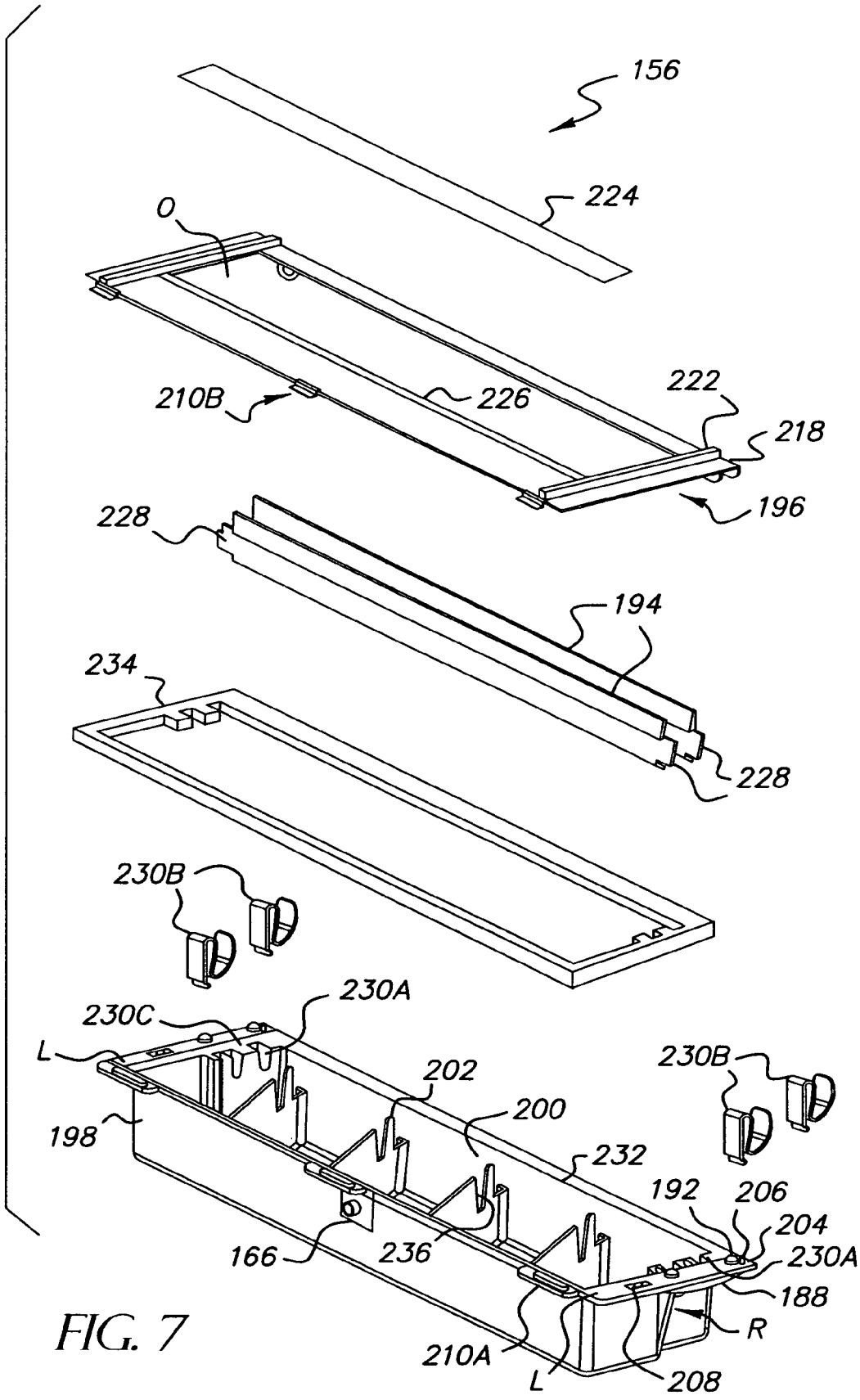
FIG. 7 is an exploded view of the web cleaning cartridge and its customer-replaceable components such as the cleaning blades and the cover assembly shown in FIG. 4.

An explosion view of the web-cleaning cartridge components is shown in FIG. 7. The cartridge is composed of the sump housing 198 which is generally a rectangular structure, defining a cavity 200, also referred to as a reservoir, with integral molded baffles 202, and releasable wiper blades 194 each having an end-piece 228 that is seated into a molded groove 230A at the ends of the sump and each end-piece 228 is locked into the groove 230A by a locking spring 230B to hold the wiper blade in the optimum location in the sump so that the wiper blades 194 do not fall out when inverted; and a removable cover assembly 196 to facilitate the removal of debris material from the sump housing 198 without removing the wiper blades 194. The locking springs 230B are inserted into cutouts 230C molded next to the grooves 230A to form hinges 230 to lock the wiper blades 194 in the proper orientation. The sump housing 198 has a seat feature 232 along its perimeter that is covered by a gasket seal 234 to seal around the interface between the sump housing 198 and the cover assembly 196. The gasket seal thickness should be slightly higher than the seat height to allow for slight compression and thus sealing.

The molded sump and components described above in one preferred embodiment are made from an injection-molded plastic having a carbon doping for static dissipative purposes to avoid excessive charge build up. Preferably, the volume resistivity of such plastic material is between $10^8$ to $10^{11}$ ohm-cm.

In the preferred embodiment these seals 22 serve both to minimize any leakage of scavenged particles out of the sides of the sump during use of the cartridge, and have an adhesive on the side facing the lid member and a wear-resistant fabric, e.g., Nylon, on the side facing the web 128. These seals minimize any leakage of scavenged particles from the sides of the sump during use of the cleaning apparatus. One molded sump component shown in FIG. 3A is a rib-like protrusion that is molded in the side of the sump housing 198 so that when the sump is placed in position by the operator these one or more rib(s) will cooperate with the lower bosses to prevent the web-cleaning cartridge from being installed incorrectly. The foam portion of the seal needs to be of high resiliency, low density, and a low compression set to maintain a good seal and to reduce any drag torque on the transport web 128. A preferred foam material is R200/U polyester having a density of 2 lb. per cubic cm. The Tricot fabric also serves to reduce friction between the web surface and the seals, and can provide some cleaning of the web surface not covered by the blades.

The cover assembly 196, that releasably attaches to the top of the sump housing 198, serves not only to prevent scavenged particles from escaping through the top of the sump housing, but also includes several features that enable easy attachment to the sump housing. Both the cover assembly 196 and the sump housing 198 include quick disconnect features which enable them to be decoupled. The cover assembly 196 has a hinge 210, that is formed by the mating of a hinge device, the tabs 210B, into the hinge receiver, molded slots 210A, in the sump housing, that can be de-coupled from the sump housing 198 to allow the debris to be easily removed when dumping the apparatus. In a preferred embodiment this device includes a hinge 210 that has a hinge receiver, in this case a slot 210A molded as part of the sump housing 198, for releasably receiving the hinge device, tabs 210B, on the cover assembly 196 to provide a pivotal connection between the cover assembly 196 and the sump housing 198. The cover assembly 196 has one or more fasteners 218. The hinge devices or tabs 210B are adapted to be readily removed from the slots 210A to enable the cover to be de-coupled from the assembly so that the cover assembly 196 is customer replaceable as shown in FIG. 8.

Figure 8:
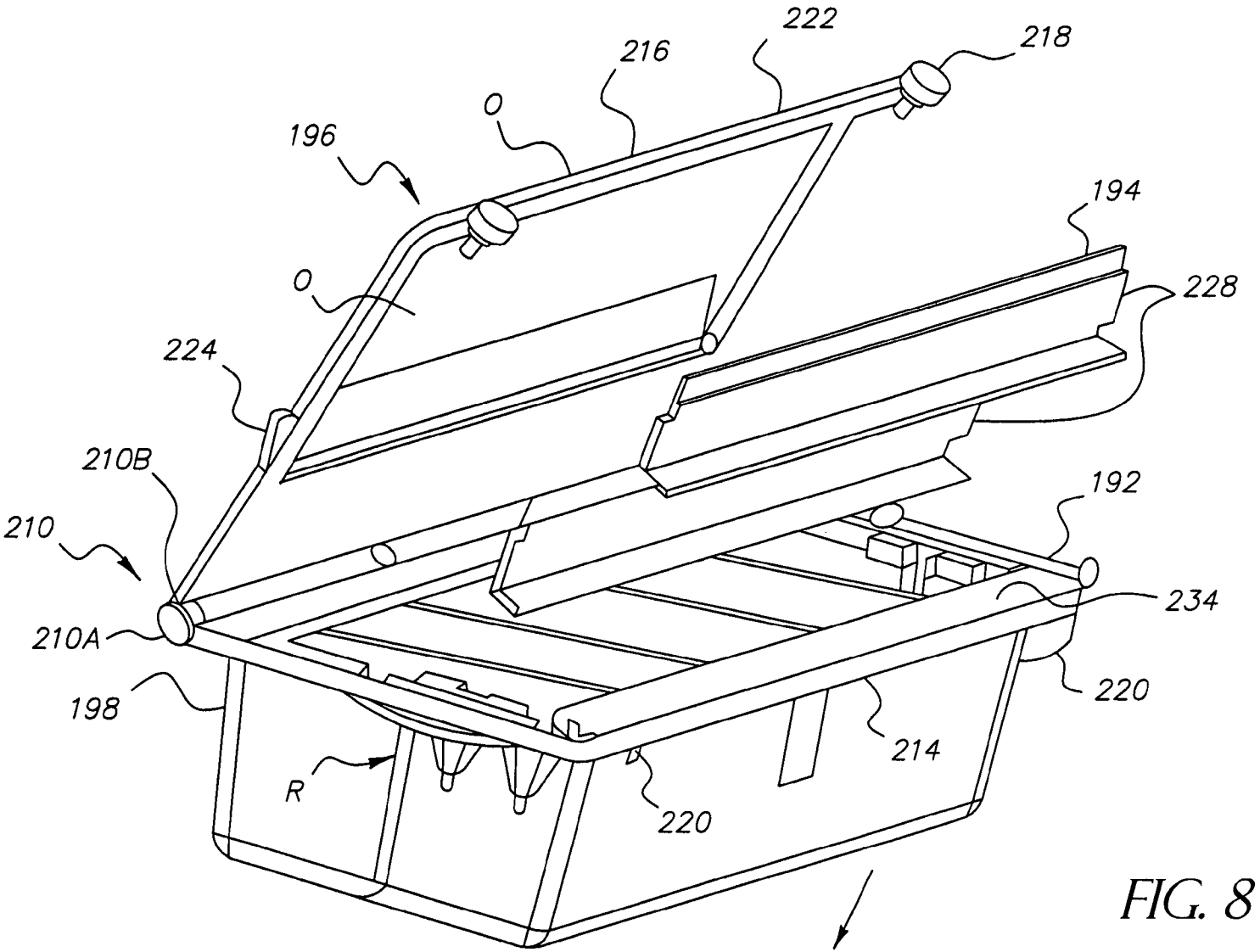
FIG. 8 is a perspective view of the cover assembly as it is being removed to allow dumping the waste toner and replacement of the cleaning blades.

FIGS. 8-9 show a preferred embodiment of the quick-disconnect features associated with the wiper blades 194 and specifically with the wiper blade end-piece 228. The wiper blades 194 are spring biased, in relation to the sump grooves 230A, by locking springs 230B to facilitate dumping of the debris material removed from the web without removing the wiper blades or without the wiper blades dropping out when the sump is inverted to dump the debris material or otherwise be cleaned or worked on. The wiper blade end-piece 228 cooperate with a quick release receiver 230, which is shown as a locking spring 230B that forces the wiper blade 194 in registration to one side of the groove 230A to define the wiper blade cleaning angle and engagement with the web, but it could be a number of releasable devices that would cooperate with the wiper blade end-piece 228 to allow the customer to quickly release the wiper blade 194. Other types of releasable devices include a wedge and a fastener. This quick release receiver 230 not only facilitates the removal of debris material from the sump without removing the wiper blade but allows the customer to properly position the blade in the cleaning apparatus with respect to web 128 and can compensate for wear induced orientation changes.

The cleaning or wiper blades 194 (shown in FIG. 8) are adapted to contact and wipe particles from the outer surface of the moving web 128 and the sump housing 198, for supporting the cleaning blades and for receiving and storing particles wiped or scavenged from the outer surface of web 128 by the cleaning blades.

Since the cover assembly 196 releasably attaches to the top of the sump housing 198 there is the need for additional features such as one or more seals to prevent scavenged particles from escaping through the top of the sump housing, and also enable easy attachment of the cleaning blades and the cover. A gasket seal 234 is permanently attached to the perimeter of the sump seat 232 at the cover assembly-sump interface to prevent scavenged particles from escaping through the top of the sump housing. The gasket seal 234 might have some adhesive on the surface facing the sump to permanently attach itself to the sump. The gasket seal 234 could be made with plush material or foam material. The gasket seal material should have high resiliency, low density and low compression set to maintain good sealing between the sump and cover. A preferred foam material is R200/U polyester having a density of 2 lb. Per cubic cm and it might have antistatic additives but other materials having similar properties might e suitable including plushes made of Acrylic, Polyester, or Nylon fibers. The cover also includes a pair of side seals, also sometimes referred to as end dust seals, 222 attached to cover and cooperating with the blades at both ends of the sump housing where the blades ends are placed in the sump. These side seals 222 serve both to minimize any leakage of scavenged particles out of the sides of the sump during use of the cleaning apparatus and to wipe particles from the sides of the web.

In a preferred embodiment these side seals 222 are made of a material that most efficiently prevents the release of dust and other contaminants from the sump housing 198. In a preferred embodiment this includes one of foam, pile, plush material, having high resiliency, low compression set and low density. In one embodiment, the side seals are made of R200/U polyester foam having a density of 2 lb. Per cubic cm and having a Tricot fabric attached to the surface facing the web 128 to reduce friction and the load between the web and the seals. The Tricot fabric can provide some cleaning of the web surface not covered by the blades. In another embodiment, the side seals 222 are made of plush material such as Acrylic, Polyester, Polypropylene or Nylon and these fibers could have antistatic additives to reduce charge build up. These side seals 222 may be permanently attached to the cover assembly by having an adhesive on the surface facing the cover. It is important that these side seals have minimum gaps with the ends of the wiper blades. Preferably the gaps between the side seals and the ends of wiper blades should be less than 0.5 mm.

Also shown in FIGS. 8-9 is a blade seal 224 spaced apart from the blades to prevent dust escaping from the space between the blades and the cover. In a preferred embodiment this blade seal 224 is a Mylar seal adjacent the wiper blade 194. This blade seal 224 can be permanently attached to the cover by having an adhesive strip matching the tab feature 226 in the cover.

Figure 9A:
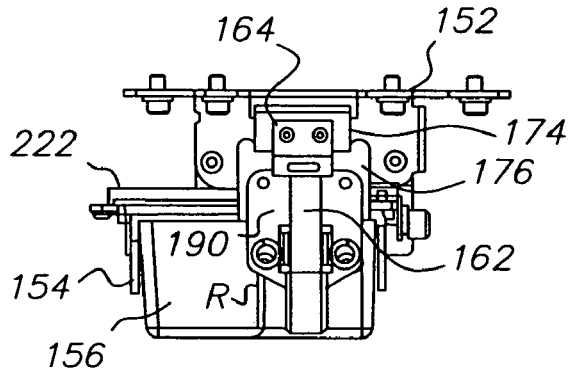
FIGS. 9A-9D are several cross-sectional illustrations of the FIG. 2 apparatus showing several important details of the interactive components of a web-cleaning cartridge and the other two major components of the apparatus.
Figure 9B:
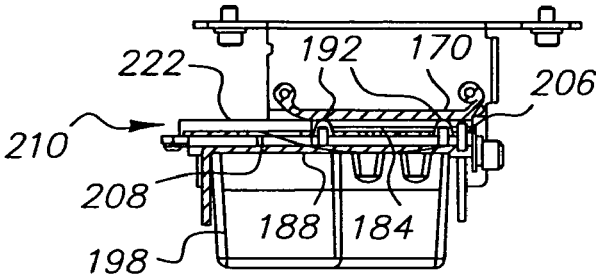
Figure 9C:
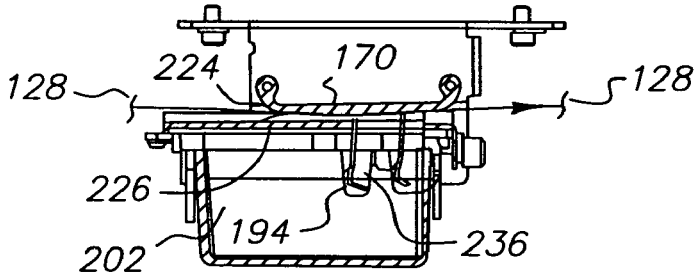
Figure 9D:
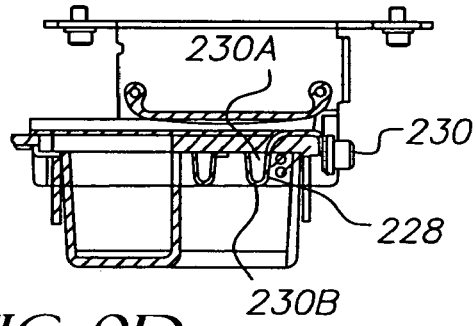

The sump housing shown in FIGS. 7 and 9C-9D includes several additional features that enable easy attachment of the wiper blades 194. The molded baffles 202 in a preferred embodiment have a plurality of spaced walls that are arranged at a common angle (between about 15 and 45 degrees) relative to the side walls of the sump housing and include one or more notches 236 that prevent misplacement of the wiper blades. Baffle notches 236 are cut to model the wiper blade's asymmetric cross-section so that the operator cannot install the wiper blade incorrectly. If the wiper blade is inverted or sideways the bend in the blade stiffener will interfere with the baffle preventing the operator from installing the blade. This allows the operator to confidently replace the blades and prevent misalignments that could damage the web or reduce blade engagement with the web. The sump housing 198 also has one or more grooves 230A cut in the sump perimeter adjacent the cavity of a shape similar to the wiper blade end-piece 228 so that groove 230A and wiper blade end-piece 228 can cooperate to assure a precise fit and desired orientation of the wiper blades in the sump. In a preferred embodiment the quick release receiver can be a spring 230B that fits in the groove 230A and a cutout 230C so that the locking spring cooperates with the groove and cutout to clamp against them and hold the blade in place in such a way that the spring is biased to assure a precise fit and desired orientation of the wiper blades in the sump. This allows the consumer to confidently replace the blades and prevents misalignments that could damage the web. The double protection of the groove 230A and the locking spring 230B to accept the wiper blade end-piece 228 and the notched baffle 236 ensure precise and correct installation.

In one preferred embodiment the web-cleaning device includes a baffle that is positioned within the sump housing to prevent the sudden displacement and subsequent spillage of scavenged particular material when the bracket assembly is moved to the service position during which the web-cleaning device can be removed.

The web-cleaning cartridge 156 is attached to a lower bracket assembly 154 by the insertion of the lower bosses 166 into the side slots 168 of the lower bracket assembly, and then installed into backup shoe assembly 152 for selectively positioning said web-cleaning apparatus 150 in a web-cleaning position in which said web-cleaning apparatus pressingly engages the web surface. The lower bracket assembly 154 and the backup shoe assembly 152 selectively positions the web-cleaning apparatus in a web-cleaning position, as shown in FIG. 3A, using shoe 170 having a hard surface adapted to contact the web surface opposite that contacted by the wiper blades and to resist the force exerted by the wiper blades and a lower bracket assembly 154 for releasably supporting the web-cleaning apparatus. The lower bracket assembly 154 is mounted to the backup shoe assembly 152 at the above-mentioned fixed location along the web path. In a preferred embodiment the backup shoe assembly 152 is permanently fixed to the web transport and is not normally moved by the customer. Alternatively, in another embodiment, the backup shoe assembly 152 can be mounted relative to the lower bracket assembly 154 to allow movement between a first operative position in which said web-cleaning component exerts a substantially uniform pressure on the web, and a second operative position in which the web-cleaning component exerts an equally substantially uniform pressure on the web 128 when the apparatus is relocated and has features that cooperate with features on the sump housing, wiper blade and/or cover to assure a desired orientation of said wiper blades in the sump cavity.

FIGS. 9A-D shows various cross-sectional illustrations of interactive components of the web-cleaning cartridge 156 with the backup shoe assembly 152 and lower bracket assembly 154.

FIG. 9A shows the front of the web-cleaning apparatus with the latch 162 mounted to a latch bracket 190. The latch bracket 190 is fixed to a front tab feature 176 of the lower bracket assembly 154. This front tab feature 176 has a mating feature that aligns with another front tab feature 174 in the front bracket of the backup shoe assembly 152.

FIG. 9B is a cross-section along the stop features 192 of the sump housing 198 and it shows the end spring 188 that is held in the sump by a rivet 206. The sump has a small cutout feature 208 that allows the free end of the spring to move freely. Notice the end spring 188 is shown in its uncompressed state but under the operating position, this spring is actually compressed by the action of the lower bracket flat surface 184 ensuring the stops are forced into contact with the shoe 170, and similarly the same condition occurs at the rear spring and stops, and hence the wiper blades 194 can be registered to contact with the web 128 at the desirable and precise engagement as shown in FIG. 9C.

In a preferred embodiment, the end springs 188 can force contact of the four strategically placed stops 192 in the sump in tight contact with the shoe 170, allowing for higher precision of blade engagement with the transport web 128. This is accomplished as the end springs 188 rest on the lower bracket flat surfaces 184 and 186 and as the lower bracket is latched at front with the backup assembly, this action causes the spring to be compressed thus forcing the sump towards the shoe until the stops prevent any further motion. By controlling the depth of the blade groove with respect to the stops and the blade dimension from the end piece resting on the groove to the blade edge contacting the web, the amount of interference between the polyurethane and flexible part of the wiper blade with the shoe can be controlled.

FIG. 9C is another cross-section to show notches 236 in the baffle 202 that prevents the wiper blades 194 from being installed incorrectly into the cartridge and it also shows the wiper blades being held in grooves 230A by locking springs 230B and the blade edges are in precise engagement with the web 128 riding under the shoe 170. The Mylar seal blade 224 is also shown mounted to the tab feature 226 on the cover to contact the web 128 under the shoe 170.

FIG. 9D is another cross-section illustrating the wiper blade hinge 230 receiver such as locking spring 230B biasing the wiper blade end-piece 228 onto the side of the groove 230A to form the desirable angle between the blade edge and the moving web 128 that is shown in FIG. 9C.

Another molded component of the sump housing includes a lower boss 166 that lockedly engages the lower bracket assembly 154 through a slot 168. In a preferred embodiment it is important that the sump housing 198, including all its features, be molded with a static dissipating material. This is critical to prevent the unwanted build-up of static charge that would interfere with quality and efficiency during the printing process and possibly damage equipment and make the operators experience unpleasant.

One preferred embodiment of the sump has a combination of the above features, including one or more stops 192, one or more side seals 222, such as the continuous gasket seal, the Mylar blade seal 224 adjacent the wiper blade 194, and two end seals. It also would have the end springs mounted to the body at front and at rear, and said springs resting on the top surface of the lower bracket and the bottom surface of the sump housing, to provide a normal force that is distributed between the above mentioned stops 192, when the lower bracket assembly is latched at front to the backup shoe assembly and supported at the rear by the pins, to bias the stops toward the back up shoe assembly. The web-cleaning cartridge would also have baffles 202 with one or more notches 236 that prevent misplacement of the wiper blades; one or more releasable wiper blade(s) including a releasable feature, each having spring 230B, to lock the wiper blade in the optimum location in the sump so that the blades do not fall out when inverted to dump waste materials; and a removable cover to facilitate the removal of debris material from the sump without removing the wiper blade(s).

One skilled in the art will understand that this apparatus can allow the lower portion of the sump body to engage the lower bracket assembly in such a way that the assembly prevents the operator from removing the sump assembly incorrectly, thus causing damage to the end springs and other components, or inserting the sump assembly incorrectly. The sump can be removed by pulling apart the sides of the lower bracket. In one preferred embodiment this safeguard requires the operator to remove the lower bracket assembly with the sump assembly as a unit for servicing such as dumping waste, replacing customer replaceable wiper blades or cover assembly, or vacuum cleaning the cover especially around the end seals.

The lower bracket assembly is pivotally mounted to one end of the back-up shoe assembly to enable the cleaning apparatus to be moved between an operative position (shown in FIG. 1) in which its cleaning components engage web and press against the backup shoe, and a service position (shown in FIG. 3B) in which the we-cleaning cartridge and lower bracket assembly as a unit is sufficiently spaced from the web to enable it to be removed for servicing and/or replacement.

The cleaning apparatus allows a method for assisting a customer in removing a web-cleaning apparatus adapted to contact a surface of a moving web and to remove particles from the web with a quick release device to be greatly simplified. The customer will first release the latch at the front of the lower bracket from its' latching keeper at the front bracket of the backup assembly and then remove the lower bracket assembly with the web-cleaning apparatus. The latter can then be placed on a table for further servicing. For servicing the web cleaning apparatus, the customer will remove a releasable cover component by first loosening the fasteners on the cover and then rotating the cover out of the upper boss in the sump and about the hinge/slot features of the cover and sump and then pulling the hinges out of the slots. This enables the cover to be physically de-coupled from the sump and/or lower bracket to facilitate the removal of debris material from the sump without removing the wiper blade(s). The operator might prefer to remove the web cleaning apparatus from the lower bracket and this can be done by pulling the side of the lower bracket apart to allow the lower boss that engages the lower bracket assembly to be removed from the slot features of the lower bracket and this operation which enables the lower bracket assembly to be physically de-coupled from the sump thereby facilitating assembly or web service and/or replacement. Then a releasable wiper blade component including an end piece that locks the wiper blade in the optimum location in the sump so that the blades do not fall out when inverted but is releasable from the sump and cover to facilitate the removal of debris material from the sump after removal of the wiper blade(s) or for replacing the customer replaceable wiper blades.

If the customer is using a preferred embodiment discussed above, the customer will only have to remove the lower bracket assembly with the web cleaning apparatus as a unit. This avoids damage to the end springs by too much handling of the apparatus from the operator and provides the customer a number of additional safety features. These safety features are based on the fact that if the web cleaning apparatus were easily replaceable then when the operator were to install the spring loaded cleaner, the springs at rear could interfere with the lower bracket feature at the rear and this might lead to damage to the spring, rivet or sump feature that allows the attachment of the spring to the sump.

The customer should be able to remove the cover assembly and then invert the lower bracket with the sump assembly in place to dump the waste material into an anti-static plastic bag or a similarly suited container without having to remove the wiper blades. The customer might prefer to dump the waste by removing the wiper blades to vacuum clean the sump or by other means. Because of the inherent higher precision of mounting the wiper blades to the web surface, the web cleaning apparatus reduces the variability in the torque load against the web drive plus it also allows for lower wiper blade engagement with the web and thus reducing the torque load needed for cleaning said web of particulates. Lower wiper blade engagement allows for higher blade working angle with the moving web, which is more effective to cleaning operation. The de-coupling of the sump from the lower bracket assembly might only be required if a new web cleaning apparatus is needed. We expect this operation to seldom be needed.

The invention has been described in detail with particular reference to certain preferred embodiments thereof, but it will be understood that variations and modifications can be effected within the spirit and scope of the invention.

PARTS LIST

100 electrophotographic document printer
102 primary image-forming member
104 photoconductor drum, image recording member
106 corona charger
108 LED writer
110 magnetic brush applicator
112 intermediate image-transfer member
114 transfer nip
115 cleaning brush
116 electrically conductive drum
118 compliant blanket
120 hard overcoat
122 power supply
S image-receiver sheet
124 transfer nip
126 small transfer roller
128 endless sheet-transfer web
130 cleaning brush
132 feed station
134 drive roller, grounded
136 transport roller, grounded
L Lips of sump, front and rear
Motor
O Opening in the cover assembly
138 corona charging station
140 transfer roller power supply
142 detack charger
144 web conditioning charger
150 web cleaning apparatus
152 backup shoe assembly
154 lower bracket assembly
156 web cleaning cartridge or device
B mounting screws
158 hole pattern, lower bracket assembly, rear
160 notched pins, backup shoe assembly, rear
162 latch
164 latch keeper
166 lower bosses, web-cleaning cartridge, sides
168 slot features, lower bracket assembly, sides
170 shoe
172 front bracket, backup shoe assembly
174 tab feature of front bracket, backup shoe assembly
176 tab feature, lower bracket assembly
178 rear bracket, backup shoe assembly
N notches in rear pins 160
180 side tabs, backup shoe assembly (static dissipative brush)
182 rectangular opening, lower bracket assembly
184 front and rear flat surfaces, lower bracket assembly
186 front and rear flat surfaces, lower bracket assembly
188 end springs, web-cleaning cartridge
190 latch bracket, lower bracket assembly
192 stops, web-cleaning cartridge sump
194 cleaning or wiper blades
196 cover assembly
198 sump, sump housing
200 cavity or reservoir, sump
202 integral molded baffles with notches, sump
204 cutout for rivet, sump
206 rivet, end spring
208 cutout for free end of spring 188, sump
210 hinge formed by slots 210A, and tabs 210B
210A slots or hinge receiver, sump
210B tabs or hinge device, cover assembly
214 upper boss, sump
216 notch feature in cover assembly
218 fasteners, cover assembly
220 thread inserts molded in the sump
222 side seals
224 blade seal
226 tab
228 wiper blade end-piece
230 hinge for blade holder
230A molded groove
230B locking springs for wiper blades
230C cutout for locking spring
232 seat feature for a gasket seal, sump
234 gasket seal, foam gasket, foam seal
236 baffle notches
R molded ribs, front and rear of sump

The invention claimed is:

1. A surface-cleaning apparatus for cleaning particulate material from a moving surface in an electrographic printer, the surface-cleaning apparatus adapted to contact a surface of the moving surface and to remove particles from the surface to deposit the particles into a sump comprising:

(a) a lower bracket assembly for releasably supporting the surface-cleaning apparatus comprising one or more wiper blades;

(b) a backup shoe assembly including a shoe having a hard surface adapted to contact the surface opposite that contacted by the one or more wiper blades and to resist the force exerted by the one or more wiper blades;

(c) one or more springs located between the sump and the lower bracket assembly to align the sump with the shoe;

(d) a web cleaning device having sides including one or more lips and defining a cavity, and one or more molded components, the web cleaning device comprising one or more stops are located on a side lip so that the one or more springs can bias the one or more stops to the shoe to reduce the tolerance between the one or more wiper blades and the surface; and (e) a cover assembly to facilitate the removal of the particulate material from the sump without removing the one or more wiper blades.

2. The apparatus of claim 1 wherein the one or more molded components comprises a stop positioned to cooperate with the one or more springs to precisely position the one or more wiper blades in relation to the surface.

3. The apparatus of claim 1 wherein the one or more molded component is a locking device that locks the sump in place proximate the lower bracket assembly.

4. The apparatus of claim 1 wherein the one or more molded components comprises a pair of stops proximate each of two opposite sides of the sump positioned to cooperate with the one or more springs proximate each of the two opposite sides of the sump, to precisely position the one or more wiper blades in relation to the surface.

5. The apparatus of claim 1, wherein the one or more molded components comprises the one or more stops positioned to cooperate with the one or more springs to precisely position the one or more wiper blades in relation to the surface and the one or more molded components further defines a cutout proximate an end-piece of the one or more wiper blades such that the one or more springs further cooperates with the cutout.

6. The apparatus of claim 1 further comprising a baffle including one or two notches to prevent misplacement of the one or more wiper blades.

7. The apparatus of claim 1, the sump further including one or more grooves to cooperate with the one or more wiper blades which would be capable of having a wiper blade end-piece to assure a precise fit and desirable orientation of the one or more wiper blades in the sump.

8. The apparatus of claim 1 wherein the one or more molded components defines a groove and a cutout that cooperates with the one or more springs to lock the one or more wiper blades in place.

9. The apparatus of claim 1 further comprising one or more cone-shaped, notched pins that are mounted to a rear of the backup shoe assembly to guide the lower bracket assembly in place and to retain or support the lower bracket assembly in place when the lower bracket assembly is dropped at front.

10. The apparatus of claim 1 further comprising:

(a) a first mount for supporting the backup shoe assembly at a fixed location adjacent a path of movement of the surface; and (b) a second mount for pivotally connecting an end of the lower bracket assembly to the backup shoe assembly to enable the surface-cleaning apparatus to move between an operative position and a service position; and (c) a latch for releasably latching the two assemblies in a position in which the surface-cleaning apparatus is in its operative position.

11. The apparatus of claim 1 wherein the one or more molded components includes a baffle located in the sump.

12. The apparatus of claim 11 wherein the baffle is shaped to prevent movement of the particulate material outside the sump during movement of the sump.

13. The apparatus of claim 11 wherein the baffle further includes one or more notches that prevent misplacement of the one or more wiper blades.

14. The apparatus of claim 11, the sump further including one or more grooves to cooperate with a wiper blade end-piece of the one or more wiper blades to assure a precise fit and desired orientation of the one or more wiper blades in the sump.

15. The apparatus of claim 1 wherein the one or more molded components include one or more strategically placed guides, tabs, the one or more stops, ribs and fasteners.

16. The apparatus of claim 1 wherein the one or more molded components includes an upper guide boss that engages the cover assembly to align the cover assembly and the sump to enable a fastener to be fastened.

17. The apparatus of claim 1 wherein the one or more molded components includes one or more ribs to act as barriers to prevent improper placement of the sump.

18. The apparatus of claim 1 wherein the one or more molded components includes a hinge portion that releasably engages the cover assembly.

19. The apparatus of claim 1 further comprising a hinge portion including a slot formed therein for releasably receiving a mounting feature on the cover assembly to provide a pivotal connection between the cover assembly and the sump.

20. The apparatus of claim 19 wherein the mounting feature is adapted to be readily removed from the slot to enable the cover assembly to be de-coupled from the lower bracket assembly so that the cover assembly is customer replaceable.

21. The apparatus of claim 1 wherein the one or more molded components includes a static dissipating member.

22. The apparatus of claim 1 further comprising a dust seal.

23. The apparatus of claim 22 wherein the dust seal includes one of a continuous gasket seal, a seal adjacent the one or more wiper blades, and two end seals.

24. The apparatus of claim 1 further including a quick-release component.

* * * * *